US006946170B2

(12) United States Patent
Gerber et al.

(10) Patent No.: US 6,946,170 B2
(45) Date of Patent: Sep. 20, 2005

(54) SELF-CLEANING DISPLAY DEVICE

(75) Inventors: Ingo Gerber, Weil im Schönbuch (DE); Jan Tuma, Berlin (DE)

(73) Assignee: Gottlieb Binder GmbH & Company, Holzgerlingen (DE)

( * ) Notice: Subject to any disclaimer, the term of this patent is extended or adjusted under 35 U.S.C. 154(b) by 163 days.

(21) Appl. No.: 10/370,107

(22) Filed: Feb. 21, 2003

(65) Prior Publication Data

US 2003/0167667 A1 Sep. 11, 2003

(51) Int. Cl.[7] ..... A47G 1/12

(52) U.S. Cl. ..... 428/13; 428/141; 428/167; 428/338; 428/913; 428/913.05; 40/406; 40/407

(58) Field of Search ..... 428/141, 143, 428/913, 167, 171, 220, 332, 338, 13, 913.3; 40/406, 407, 200, 584, 616, 910

(56) References Cited

U.S. PATENT DOCUMENTS 3,354,022 A * 11/1967 Johnson Jr., et al. ..... 428/167
2003/0108716 A1 * 6/2003 Nun et al. ..... 428/141

FOREIGN PATENT DOCUMENTS

| | | | | |
|---|---|---|---|---|
| DE | 199 23 175 A1 | * | 11/2000 | ..... B29C/63/02 |
| DE | 199 43 299 A 1 | | 3/2001 | |
| EP | 0772514 | | 12/1998 | |
| EP | 1 063 071 A2 | | 12/2000 | |
| EP | 1 063 071 A3 | | 4/2002 | |
| EP | 0933388 | | 10/2002 | |
| EP | 1 317 967 A2 | * | 11/2003 | ..... B05D/5/02 |
| JP | 200308860 A | * | 11/2000 | ..... B08B/3/08 |

* cited by examiner

*Primary Examiner*—Michael C. Miggins
(74) *Attorney, Agent, or Firm*—Roylance, Abrams, Berdo & Goodman, L.L.P.

(57) ABSTRACT

A device displays information in identification areas of traffic signs, signposts, billboards, license plates, etc. The identification area is provided with a surface having an artificially producible base structure and other structures or itself forms such a surface having a self-cleaning effect. The base structure has or develops a capillary effect in which the quotient of capillary work and adhesion work is greater than 1. The capillaries have a negative rise, that is, liquid is pressed form the capillaries, providing the self-cleaning effect.

15 Claims, 5 Drawing Sheets

SELF-CLEANING DISPLAY DEVICE

FIELD OF THE INVENTION

The present invention relates to a self-cleaning device for displaying of information or identifications, such as street and traffic signs, signposts, billboards, license plates, etc.

BACKGROUND OF THE INVENTION

Devices for displaying information or identifications are constantly exposed to environmental effects, particularly in the form of pollution. This applies especially to the field of road traffic, and sooner or later impairs the legibility of information displayed. Particularly in the area of safety-relevant information, cleaning of the respective device becomes necessary, involving corresponding costs in the form of time and money. Such devices preferably should be self-cleaning to lighten the burden of the maintenance costs in question.

EP-B-0 772 514 discloses self-cleaning surfaces of objects having an artificial surface structure including elevations and depressions of a single type. The distance between elevations ranges from 5 to 200$\mu$. The height of the elevations ranges from 5$\mu$ to 100$\mu$. In addition, at least the elevations are made of water-repellent polymer materials or ones rendered water-repellent for protracted periods, and are not to be detachable by water or water containing detergents.

The disclosed surface has such elevations for repelling pollutants, a lotus leaf structure being imitated artificially. This structure is known to be self-cleaning in the sense that it is not contaminated. Even commercially available adhesives are repelled by the biological structure. Despite noteworthy results as regards self-cleaning effects, the disclosed surfaces may be employed only within limits, since either the area of materials to be used in manufacture is greatly restricted or the surface must undergo costly finishing operations related to hydrophobizing. Such surfaces are accordingly applied in facing design or as exterior wall paint. It has been found in practice, however, that the surfaces produced in this manner with the "lotus effect" often do not yield the desired results with respect to self-cleaning.

EP-A-0 933 388 discloses a structured surface possessing water-repellent and/or oil-repellent properties and low surface energy. These surfaces exhibit large wetting angles with water, with difficulty are wetted with water, and consequently, exert a self-cleaning effect. In order to accomplish such effect, an artificially producible base structure is provided with two different types of projections. One type of smaller projections are mounted on a superstructure, and are in the form of geometrically larger projections immediately adjacent to each other. To produce the disclosed projections and the superstructure as projections of another type, the latter are simultaneously or sequentially impressed into the surface material mechanically, etched in by lithographic processes, applied by a shaping process or obtained by casting technology. In the mechanical impressing process, force is suitably applied from the rear side toward the surface. The two types of structural elevations on its opposite side are then formed. The casting, impressing, etching, and application processes used for this purpose are not suited for industrial-scale production of large quantities of structured surfaces, even though this disclosed system yields very good results in the case of self-cleaning, which incidentally has its counterpart in nature in the form of the leaf surface of the nasturtium.

SUMMARY OF THE INVENTION

Objects of the present invention are to provide a surface characterized by a very good degree of cleaning to remove fouling and permitting cost-effective industrial-scale production of devices for displaying information or identification areas protected from permanent fouling.

An identification area is provided with a base structure which may be artificially produced and with other structures or itself forms such an area which is self-cleaning. The base structure has or develops a capillary effect in which the quotient of capillary work K and adhesion work A (K/A) is greater than 1. The capillary structure with its capillaries have a so-called negative rise, that is, liquid is forced from the capillaries. This negative use applies in particular to liquids whose angle of contact with the structured surface ranges from 90° to 180°. The respective effect of the capillaries on the surface is described by the capillary work K and the adhesion work A. Since the capillary work K draws the drop from the structure, while the adhesion work A, on the contrary, tries to keep the drop in the structure, selection of a quotient for the two forms of work in question greater than 1 allows the drop, if it enters the capillary opening to exert a moisturizing effect, to experience an opposite force, one which makes self-cleaning possible.

In one preferred embodiment of the device of the present invention, the respective structure has a capillary or forms one, with a mean capillary radius $r_K$. The mean capillary radius is smaller than the radius $r_T$ of the smallest drop of water occurring in the environment, especially the raindrop.

Since different drop sizes occur in application of the self-cleaning structured surface, it is additionally important for configuration of the structured self-cleaning that the capillary radii $r_K$ be smaller than the radius of the smallest raindrop occurring in the environment $r_T$. In addition, the raindrop falling free of impact is considered, i.e., one which may disintegrate or break up into several small drops on impact on any surface.

It follows from this consideration that the relationship $r_K<r_T$ is required for a small drop not to fall into the structure, and thus, for no negative rise to occur in the capillaries. Different capillary radii then result for different liquids such as oil, water, chemical liquids, etc. from the different liquid properties. If the capillary action is produced by geometric structures other than tubules, such as pyramidal, conical, or truncated-cone projections, a mean or average capillary radius $r_K$ is to be determined for these structures during the design process.

In another preferred embodiment of the device of the present invention, the device is formed at least in part of hydrophilic materials, especially of plastics such as thermoplastics or duroplastics. Especially, the plastics can be polyvinyl chloride, polyterephthalate, polymethyl methacrylate, or polyamide. Unlike the conventional devices, to increase the degree of anti-fouling, in place of water-repellent or oil-repellent surfaces, a hydrophilic material is used by means of which an average expert in this area surprisingly can accomplish a higher degree of anti-fouling than with previously disclosed structures. Since the base structure for the surface is in the form of a hydrophilic plastic, the material attracts water and absorbs moisture. The water molecule or the moisture contained in the material forms a protective or separating layer on the surface, which layer possesses improved anti-fouling properties.

In another improved embodiment of the device of the present invention, the surface and the identification area may be joined to each other by a transparent adhesive. Preferably, such adhesives are rubber-based hot melts or polyolefins. In addition, acrylates from aqueous dispersion and solution may be applied. Preference may also be given to use of monomers and oligomers cross-linked by radiation as adhesives.

It is also possible to form the identification area immediately as the kind of surface shown. The identification content is then applied to the identification area as thus modified, for example, by spraying, spread coating, imprinting, and the like.

In another preferred embodiment of the device of the present invention, the structure is a part of a stalk on the free end of which at least one capillary projects into the open. A plurality of capillaries may also be introduced into the free ends of the respective stalk part. If the stalk parts are so close to each other that capillaries are also obtained by the interstices thereby obtained, a higher degree of cleaning may also be achieved. Introduction of the respective capillaries into the base structures only may also be sufficient.

In another embodiment, the structure is in the form of pyramidal, conical, or truncated-cone projections. The capillary is then formed by the interstices between the projections. In mathematical dimensioning, a mean capillary radius $r_K$ is determined for the interstices in question to make certain that, in keeping with the present invention, the quotient of capillary work K and adhesion work A will be greater than 1 to ensure the self-cleaning effect.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
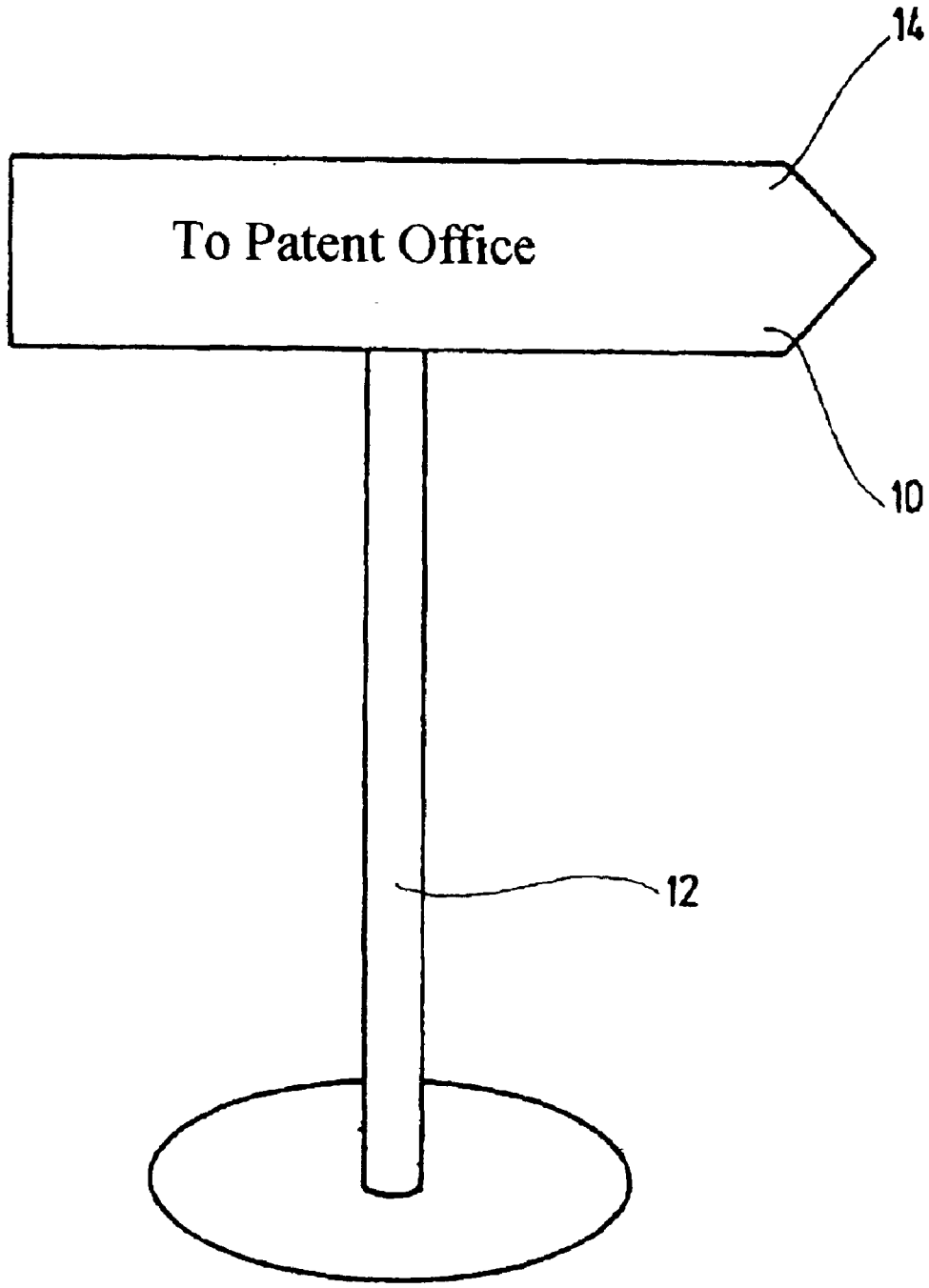
FIG. 1 is a side elevational view of a device for display information in the form of a sign reading "To Patent Office" according to the present invention.

FIG. 1 illustrates a device for displaying information in an identification area in the form of a signpost. If the signpost is exposed to environmental pollution, it may be assumed that, at least over the long term, its information data will become unrecognizable or recognizable only with great difficulty. It is of course possible to clean the respective signpost, by hand for example, but this entails corresponding cost and effort. The present invention permits self-cleaning of the signpost itself its information and/or identification.

The identification area of the signpost 12 is provided with a surface 14, as illustrated in FIGS. 2 to 6. Another possibility is that the identification area 10 may be directly in the form of surface 14 exerting an anti-fouling effect. For this purpose the surface 14 has a base structure 16 which may be artificially produced, as well as other structures 18 which exert a self-cleaning effect. The structures 18 have or develop a capillary effect, one in which the quotient of capillary work K and adhesion work A is greater than 1.

Figure 2:
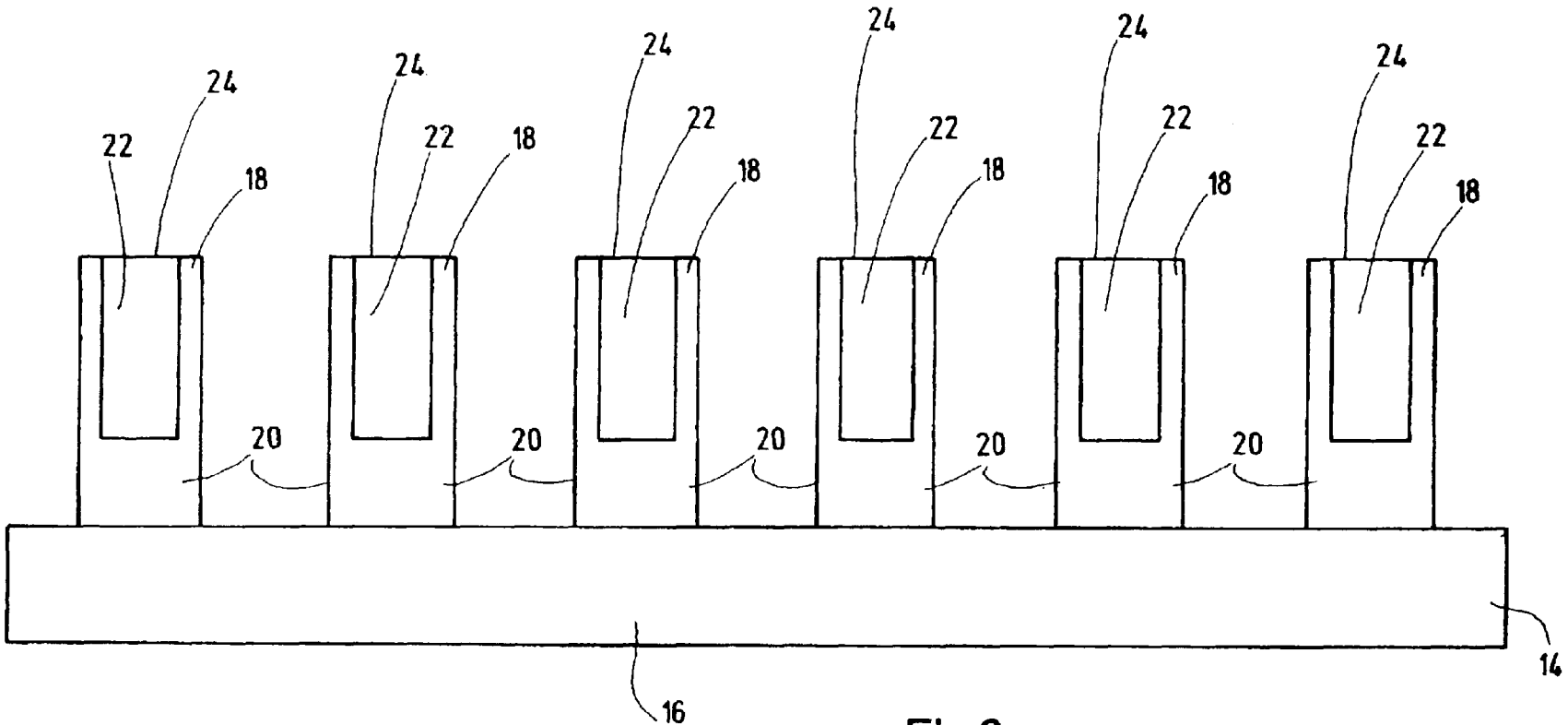
FIG. 2 is a side elevational view of a self-cleaning and anti-fouling surface according to a first embodiment of the present invention.

The surface shown in FIG. 2 has, in particular, the artificially producible base structure 16 with structures 18 mounted on it. Structures 18 are in the form of cylindrical stalk parts 20. A capillary 22 is introduced centrally into each stalk part 20 whose capillary opening 24 is free of obstruction. The stalk parts 20 may as structures 18 stand close to each other in a plurality of arrangements on the base structure 10 and preferably are joined to the latter to form one piece. In addition, the base structure 16 may be in the form of a foil, preferably of flexible configuration. If the respective foil structure is suitably thin, the foil may also be stretched or extended biaxially. Because of its elasticity, it may also return to its initial position. The surface 14 may accordingly be secured to three-dimensional objects complex in shape of any kind. The surface 14 is shown in FIG. 2 greatly enlarged. Both the base structure 16 and the other structures 18 may form microstructures, ones even in the nanometer range. Each structure 18 having a capillary 22 has on the side of the capillary opening 24 a capillary radius $r_K$ smaller than the radius $r_T$ of the smallest drop of water appearing in the environment, the raindrop in particular.

The surface 14 structured for this purpose shown in FIG. 1 is self-cleaning. The structuring is described as an arrangement of individual capillaries 22. For the capillaries to exert the desired effect, a negative rise must be achieved in the capillaries 22, that is, liquid is to be forced from the capillaries 22. This applies to liquids whose angle of contact with the structured surface 14 is between 90° and 180°. The action of the capillaries on the surface may be described in mathematical terms by the capillary work K and the adhesion work A. The capillary work K draws the drop from the structure; the adhesion work A holds the drop in the structure. The object of structure configuration is to ensure that the quotient K/A>1 as a result of appropriate choice of the capillary radius $r_K$. If $r_T$ is larger than $r_K$, the drop is then distributed over several capillaries, so that the following relationship applies:

$$\frac{r_T}{r_K}\cdot\frac{K}{A}>1$$

The following relationship describes the capillary work:

$$K-\pi h_K^2-r_K^2\cdot\rho$$

The following relationship describes the adhesion work A for cylindrical capillaries:

$$A=(\sigma_{1g}+\sigma_{sg}-\sigma_{sl})\frac{8}{3}\pi\cdot\frac{r_T^3}{r_K}$$

where

| | |
|---|---|
| $\sigma_{lg}$ = liquid-gas surface tension | $r_K$ = capillary radius |
| $\sigma_{sg}$ = solid-gas surface tension | $h_K$ = rise in capillary |
| $\sigma_{sl}$ = solid-liquid surface tension | $\rho$ = density of liquid |
| $r_T$ = radius of drop | g = acceleration of gravity (9.81 $ms^{-2}$) |

The structures of the capillary type, in contrast with the illustration in FIG. 2, may also be arranged so as to be recessed or to be a component of concave and/or convex projections in relation to the base structure 16.

Since drops of different sizes occur during use of the self-cleaning structured surface, it is also of importance in designing this surface that the capillary radii $r_K$ be smaller than the radius $r_T$ of the smallest raindrop occurring in the environment. The impact of free falling raindrops is also to be considered. Such a drop splatters on impact on any surface into several smaller drops, and so also on impact on a self-cleaning structured surface exhibiting a capillary effect. The following relationship applies to the radius $r_T$ of the smallest resulting drop:

$$r_T = \frac{\sqrt{\frac{6\sigma_{lg}}{\rho g}}}{\frac{\rho v^2 \sqrt{\frac{6\sigma_{lg}}{\rho g}}}{6\sigma_{lg}}}$$

in which:

$\sigma_{lg}$=the surface tension of the liquid g=the acceleration of gravity (9.81 $ms^{-2}$)

ρ=the density of the liquid v=the rate of fall

From this relationship, $r_K<r_T$ must be true of the capillary radius $r_K$ of the self-cleaning structured surface for a small drop not to fall into the structure and so for negative rise not to occur in the capillaries, this being precisely the condition which permits the self-cleaning. Differing capillary radii are obtained for different liquids as a result of the corresponding properties of liquids.

If the capillaries 22 are employed as structures, the effect of the capillary forces on a liquid in both directions is to be observed: Case A: Liquid is drawn into a capillary (rise $h_K$ positive) Case B: Liquid is pressed out of the capillary (rise $h_K$ negative), capillary depression.

If the drop lies on the structured surface, the drop lies above the capillary 22 and case B is of interest for self-cleaning. In this case, the liquid is forced upward against the force of gravity from the capillary 22 into the superjacent drop.

The following relationship is then obtained for the rise $h_K$ in a capillary 22:

$$h_K = 2\frac{\sigma_{lg}\cos\theta}{\rho g r_K} = 2\frac{(\sigma_{sg} - \sigma_{sl})}{\rho g r_K}$$

since:

$\sigma_{lg}\cdot\cos\theta=\sigma_{sg}-\sigma_{sl}$(Young's equation)

where $\sigma_{lg}$=liquid-gas surface tension $\sigma_{sg}$=solid-gas surface tension $\sigma_{sl}$=solid-liquid surface tension θ=angle of contact of liquid with solid surface ρ=density of the liquid g=9.81 $ms^{-2}$ (acceleration of gravity)

$r_K$=radius of capillary 22

The rise $h_K$ in the capillary 22 is a negative value in case B. All values in the formula for the rise are positive. Only the cosine of the contact angle θ is negative for the condition $$90°<\theta<180°.$$

The contact angles in question must always be greater than 90° for the desired effect to occur at all, that is, that the liquid be forced from the structures by capillary forces. The following relationship applies to the surface roughness:

$$\cos\theta'=k\cos\theta$$

where

θ'=the angle of contact with a rough surface

θ=the angle of contact with a smooth surface k=the coefficient of roughness (>1).

The relationship between the radius of the structures and the adhesion forces is also essential for the effect of capillary forces in structured surfaces, since here the adhesion forces work against capillary forces on the wall of the capillary.

In a state of equilibrium, the capillary force acting on the liquid is equally great in the direction opposite that of the force of gravity of the column of liquid displaced. For purposes of calculation, a cylinder can be imagined whose height corresponds to the calculated rise in the capillaries (in this case, for example: $\Delta h_K$=10.157 mm, in the case of water with θ=110 , ρ=998.2 $kgm^{-3}$, and $r_k$=0.5 mm).

For computational comparison, it is not the forces but the capillary work and work of adhesion which are calculated.

The capillary work K in this instance equals the product of volume, acceleration of gravity g, density ρ, and the rise h:

$$K=\pi h_K^2\cdot r_K^2\cdot g\cdot\rho$$

Work of Adhesion in a Straight Regular Cylinder A: Work of Adhesion A Over Contact Surface F:

$$A = (\sigma_{lg} + \sigma_{sg} - \sigma_{sl})\frac{8}{3}\pi\frac{r_T^3}{r_K}$$

The foregoing formula applies to a radius $r_T$ of the raindrops occurring in the environment in the lowest area of water drop size distribution, where a multiplicity of capillaries are employed.

The capillary work must be greater than the work of adhesion for the drop not to come into contact with the base of the capillary, but for the drop to be drawn from the depressions and rest on the surface, a process which results in the advantage of self-cleaning. The quotient K/A is calculated for the purpose of comparison of the orders of magnitude of capillary work K and adhesion work A.

Especially good self-cleaning effects are obtained if the surface is formed of hydrophilic materials, particularly plastic materials of polyvinyl chloride, polyterephthalate, polymethyl-methacrylate, or polyamide. These hydrophilic materials draw moisture into the base structure. In doing so, they form a protective layer against the impact of aqueous fouling elements. Other crosslinked structures, especially ones of acrylate material or such materials as have proven themselves to be biologically decomposable, may also be employed in the plastic materials referenced.

The original surface material illustrated in FIG. 2 may be obtained by the process specified in DE 198 28 856 C1. For the stalk parts 20 to be formed as desired, in the disclosed process a shaping tool such as a dandy roller is needed. The required very large number of openings in the dandy roll are obtained by etching, electroplating, or by laser treatment. This dandy roll is mounted on a papermaking wire or a structural roller. A counterhold roller rotates in the direction opposite that of the structural roller for a so-called chill roll process in which an extruded plastic material is guided through the gap between the two rollers and the stalk parts 20 are obtained in the openings in the dandy roller. To produce the capillary openings 24, the plastic material must be suitably displaced, for example, by means of mandrels introduced into the base of the dandy. Stalk parts 20 may be mounted in very high packing density on the base structure 16 and be of a form which takes up very little space.

Another process for producing surface 14 in accordance with the embodiments shown in FIGS. 2–6 can be achieved as a result of the structure of individual superfine droplets of a plastic material which are deposited in succession in selected places. Sizes or packing densities virtually as small as desired can be achieved without the need for correspondingly costly development of shaping tools. Thus, control of the locations of the deposits of plastic droplets, accomplished by appropriate relative movements between application device and a substrate carrying the deposit, preferably under computer control, can be accomplished without difficulty. It is possible to produce any configuration desired. In addition, forms may be produced which can be produced only with great difficulty or not at all with conventional shaping tools such as dandy rollers. The respective capillary opening 24 may also be generated immediately in the stalk part material by such method.

An application device can include nozzle systems capable of executing application of material in a high-speed process. Only droplets a few picoliters in size are deposited on the foil-like base structure material 16. In addition, frequencies of several kilohertz can be reached and the build-up is carried out sequentially. The plastic material previously applied is immediately made to set, for example, by means of ultraviolet radiation or the like. The respective droplet application process is described in detail in republished DE 101 06 705.4.

A very high self-cleaning effect can be achieved by a structured surface with the capillary effect of the present invention. The structures 18 may be obtained cost efficiently at the industry level and be used for a multiplicity of applications. The base structure 16 with its other structures 18 may be in the form of a foil material. The possibility immediately exists, however, of introducing the capillaries 22 into the foil-like surface 14 at least on one side. The possibility also exists of forming the identification area 10 itself as the surface 14 described, with the respective identification area 10 subsequently being provided with information content, for example, by a conventional application process such as spraying or the like.

The capillaries 22 with their capillary openings 24 may also be formed by a removal process such as by means of laser or water jet cutting. A mechanical invasive process by use of a drill or the like is also possible.

The surface 14 is preferably transparent and is joined to the upper side of the identification area 10 by means of a conventional transparent adhesive. Preferably, rubber-based hot melts or polyolefins are used. Use may also be made of acrylates applied either from an aqueous dispersion or from solutions. Monomers and oligomers crosslinkable by radiation may also be employed.

In the following embodiments illustrated in FIG. 3 and subsequent figures the same components are provided with the same reference numbers. The various embodiments are explained only to the extent that they differ substantially from the embodiment shown in FIG. 2.

Figure 3:
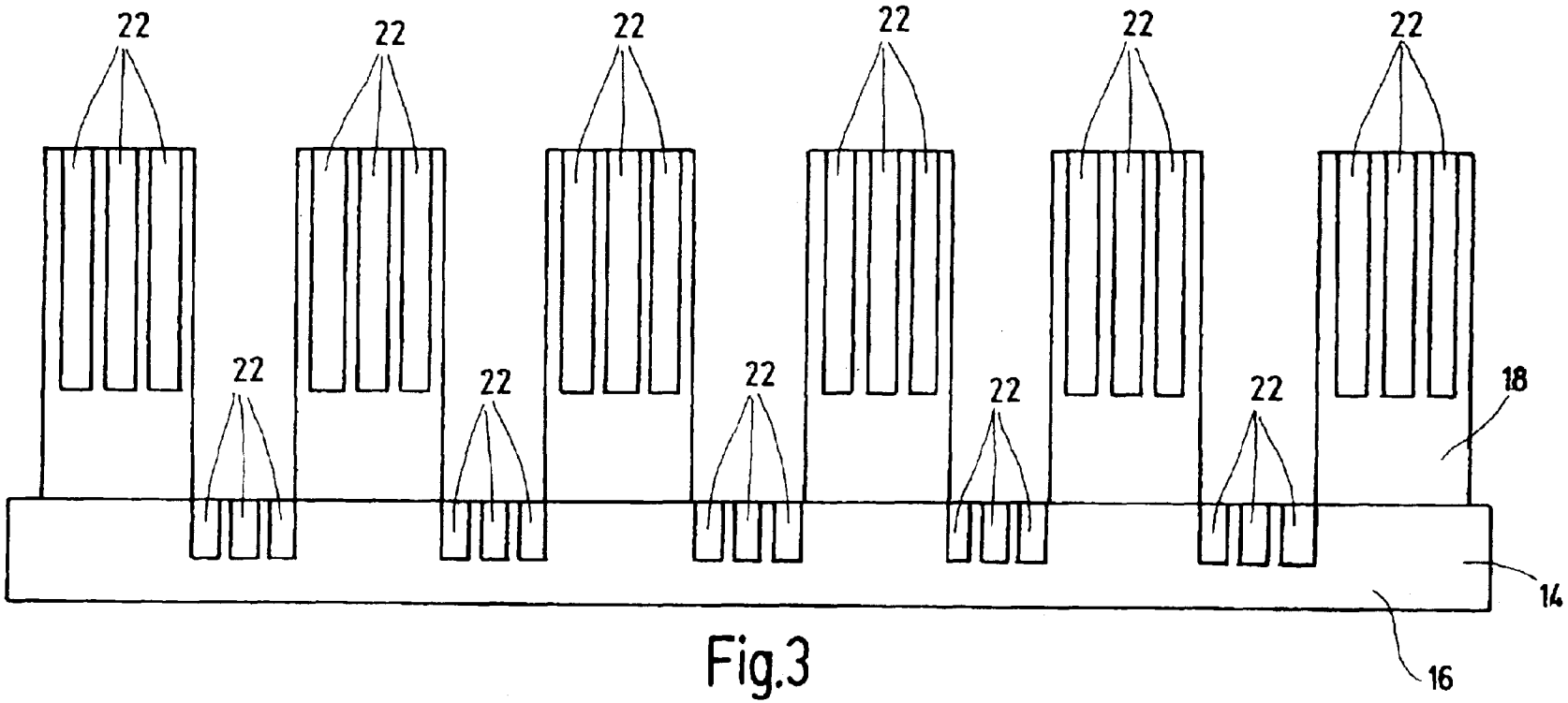
FIG. 3 is a side elevational view of a self-cleaning and anti-fouling surface according to a second embodiment of the present invention.

In the embodiment shown in FIG. 3 a plurality of capillaries 22 is introduced into the front side of each stalk part 20. Corresponding capillaries 22 are also introduced at the bottom of the base structure 16 between the respective stalk parts 20.

Figure 4:
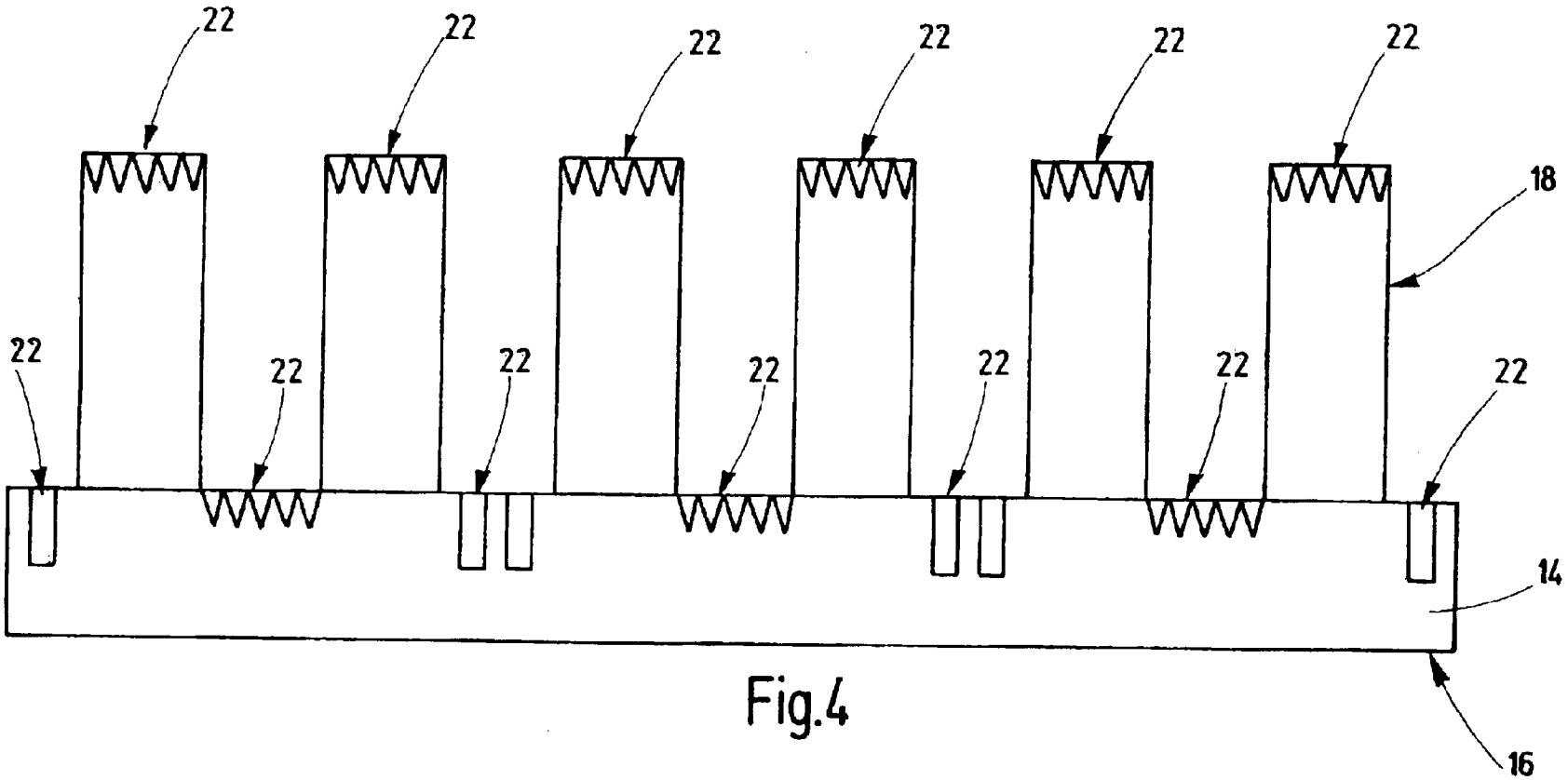
FIG. 4 is a side elevational view of a self-cleaning and anti-fouling surface according to a third embodiment of the present invention.

In the embodiment shown in FIG. 4 the respective stalk parts 20 are provided on the front side with a plurality of tapering capillaries 22. The side of the base structure 22 facing the stalk parts 20 has cylindrical capillaries 22 alternating with tapering capillaries 22. In this embodiment care must be taken to ensure that the smaller tapering capillaries 22 always yield one total capillary in the aggregate by selecting the mean capillary radius thereof such that the resulting quotient of capillary work K and adhesion work A is always greater than 1 to ensure self-cleaning.

Figure 5:
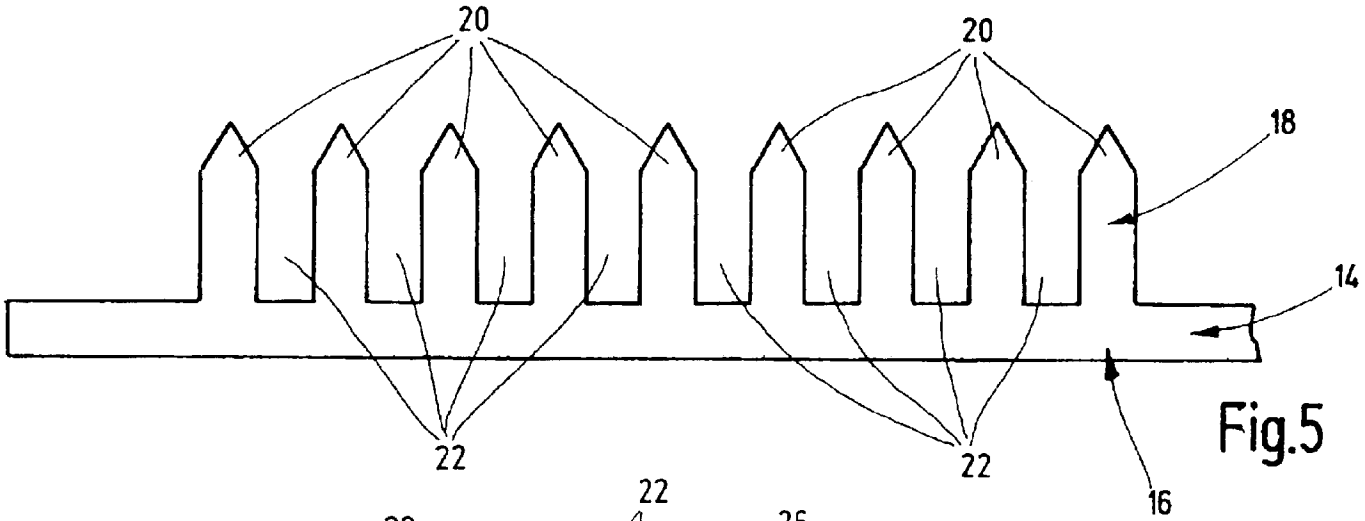
FIG. 5 is a side elevational view of a self-cleaning and anti-fouling surface according to a fourth embodiment of the present invention.

In the embodiment illustrated in FIG. 5, the stalk parts 20 have on their unobstructed or free end a roof-shaped extension. The individual capillaries 22 are formed by the intervals between the individual stalk parts 20.

Figure 6:
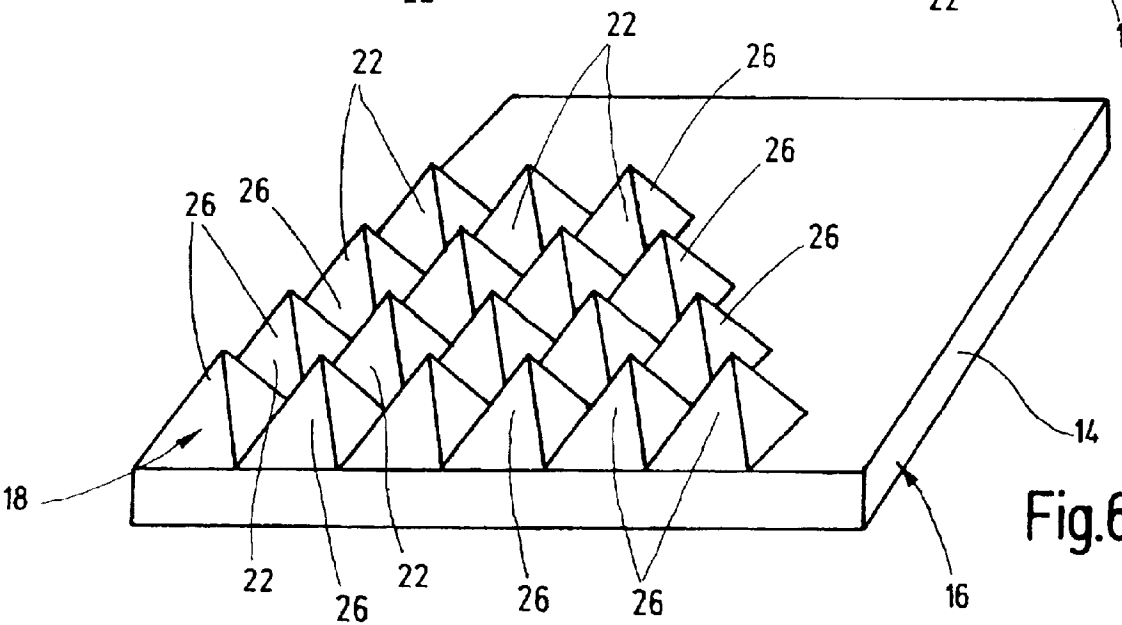
FIG. 6 is a side elevational view of a self-cleaning and anti-fouling surface according to a fifth embodiment of the present invention.

In the embodiment illustrated in FIG. 6, the structures 18 are made up of three triangular pyramidal projections. The projections rest on the base structure 16 contiguously, with no spacing in their root area. The spaces between the projections 26 then form the capillaries 22. The capillary mean capillary radius $r_K$ must satisfy the conditions described above such that self-cleaning may be ensured.

The base structure 16 preferably has a thickness of $10\mu$ to $50\mu$. The capillary depth is preferably greater than $5\mu$. The capillary radius is preferably greater than $5\mu$.

All tubules or elongated cavities (pores) with very small interior diameters are suitable as capillaries (capillary tubes) for the purposes of the present invention. As a manufactured plastic material, crosslinkable polyacrylates are particularly suitable.

While various embodiments have been chosen to illustrate the invention, it will be understood by those skilled in the art that various changes and modifications can be made therein without departing form the scope of the invention as defined in the appended claims.

What is claimed is:

1. A device for displaying information, comprising:

an identification area bearing indicia conveying information; and a surface in said identification area having an artificially producible base structure and having a plurality of discrete and laterally spaced stalk parts extending from said base structure, said stalk parts having capillaries extending therein and producing a capillary effect, where a quotient of capillary work and adhesion work is greater than 1 and thereby producing a self-cleaning effect, said capillaries having open ends free of obstructions and opening to an environment at free ends of said stalk parts.

2. A device according to claim 1 wherein each of said stalk parts has a plurality of said capillaries extending thereinto from said free end thereof.

3. A device according to claim 1 wherein said stalk parts are juxtaposed close to one another such that interstices therebetween form capillaries.

4. A device according to claim 1 wherein said identification area forms at least a portion of one of the group consisting of traffic signs, guideposts, billboards and license plates.

5. A device according to claim 1 wherein each said capillary has a mean capillary radius smaller than a drop radius of a smallest environmental drop of water.

6. A device according to claim 5 wherein said environmental drop of water is a raindrop.

7. A device according to claim 1 wherein said surface is formed, at least in part of hydrophilic material.

8. A device according to claim 7 wherein said hydrophilic material is plastic.

9. A device according to claim 8 wherein said plastic is thermoplastic.

10. A device according to claim 8 wherein said plastic is duroplastic.

11. A device according to claim 8 wherein said plastic is selected from the group consisting of polyvinyl chloride, polyterephthalate, polymethylmethacrylate and polyamide.

12. A device according to claim 1 wherein said surface and said identification are joined by a transparent adhesive.

13. A device according to claim 12 wherein said adhesive is selected form the group of hot melts and polyolefins.

14. A device according to claim 12 wherein said adhesive is an acrylate applied from the group consisting of an aqueous dispersion or a solution.

15. A device according to claim 12 wherein said adhesive is selected from the group consisting of monomers and oligomers crosslinkable by radiation.

* * * * *